United States Patent [19]

Bowler

[11] Patent Number: 4,670,935

[45] Date of Patent: Jun. 9, 1987

[54] WET VACUUM SYSTEM FOR TWO PIECE CAN LINES

[75] Inventor: Peter T. Bowler, Amherst, Ohio

[73] Assignee: FECO Engineered Systems, Inc., Cleveland, Ohio

[21] Appl. No.: 723,805

[22] Filed: Apr. 16, 1985

[51] Int. Cl.[4] ..... A47L 5/00

[52] U.S. Cl. ..... 15/306 B; 15/302; 134/67; 198/689.1

[58] Field of Search ..... 15/306 B, 302; 134/62, 134/67, 68, 104, 127, 131, 153; 198/689.1, 811

[56] References Cited

U.S. PATENT DOCUMENTS

| | | | |
|---|---|---|---|
| 3,712,455 | 1/1973 | Anfossi et al. | 198/689.1 X |
| 3,722,665 | 3/1973 | Probasco | 198/689.1 |
| 3,958,683 | 5/1976 | Schregenberger | 198/689.1 X |
| 4,102,350 | 7/1978 | Chelton et al. | 134/67 X |
| 4,167,797 | 9/1979 | Wilde et al. | 15/306 B X |
| 4,183,115 | 1/1980 | Zakarian | 15/306 B X |
| 4,235,187 | 11/1980 | Mirza | 134/67 X |
| 4,406,359 | 9/1983 | Cole et al. | 198/689.1 X |

FOREIGN PATENT DOCUMENTS

| | | | |
|---|---|---|---|
| 1912700 | 10/1970 | Fed. Rep. of Germany | 134/62 |

*Primary Examiner*—Philip R. Coe

*Attorney, Agent, or Firm*—Patrick J. Walsh

[57] ABSTRACT

A method and apparatus are disclosed for transferring can bodies from forming to washing equipment and for collecting the excess oil that drains from the can bodies in transit. In one form the invention includes a horizontal infeed conveyor for receiving can bodies in upright orientation, a vertical or elevator conveyor for bringing the cans to a second elevation and to a mass accumulating conveyor. The conveyors have perforated conveying surfaces and subjacent evacuated plenum chambers for drawing surface bound oil from the can bodies.

7 Claims, 4 Drawing Figures

WET VACUUM SYSTEM FOR TWO PIECE CAN LINES

The present invention relates to the manufacture of two-piece cans commonly used for packaging beer and beverage products and, in particular, to a system for handling the lubricant used in the process of forming two piece cans.

In the manufacture of two piece cans, can blanks are made into cups at a cupping operation, then drawn, ironed, and trimmed to length. In this fabricating process a considerable amount of lubricant, typically water soluble oil, is used. When the can body is transferred from the trimmer discharge to the can washer infeed with conventional conveying and elevating equipment, a considerable amount of the soluble oil lubricant settles on the surrounding floors thereby creating extremely hazardous working conditions in the vicinity of the manufacturing line. In addition, the manufacturing process creates an oil mist in suspension in the factory atmosphere. As a result, the lubricating oil creates sanitation and cleanliness problems in addition to extremely unpleasant working conditions particularly by reason of the oil mist permeating the atmosphere.

SUMMARY OF THE INVENTION

The present invention is directed to apparatus for transferring formed can bodies from the discharge of trimmer equipment to a washer infeed mechanism while collecting all the excess soluble oil that drains from can bodies. The collected oil may be stored or possibly recycled to the system for repeated use. As a result the work area surrounding the manufacturing line is kept completely clean and the atmosphere is not permeated with an oil mist. The cans and can bodies may now be moved from trimmer to washer including movement through an elevator at high production speeds without generating the extremely unpleasant atmospheric oil mist or creating hazardous working conditions near the manufacturing line.

A manufacturing line for producing two-piece can bodies includes equipment for producing can cups from aluminum sheet rolls, drawing and ironing the cups into can bodies, trimming the can bodies to length and washing them prior to applying can decoration. Such manufacturing equipment is interconnected by container conveyors and container handling equipment in order to achieve the high operating speeds necessary for economic and efficient production of two-piece cans. The apparatus, according to the present invention, for handling two-piece can bodies and preparing them for decoration form part of the equipment comprising a two-piece can manufacturing line. Specifically, the system of the present invention is located in the two-piece can body manufacturing line at the trimmer discharge for conducting the can bodies up to the washer infeed while collecting lubricant oil from the surface of the can bodies.

According to the present invention, containers are fed to a take away conveyor from the can body trimmer discharge equipment by means of a standard gravity drop fitting to a take away conveyor that carries the containers en masse. The take away conveyor is provided with a vacuum table applied to the underside of the take away conveyor carrier surface for drawing soluble oil that has run off the cans onto the carrier surface. The soluble oil moves through the perforated carrier surface and into a centrally located recovery system. The use of a vacuum also aids in providing stability to the containers while they are being transported on the carrier surface. The containers may be carried in a conventional manner with open-end up or down.

In one embodiment of the invention, the containers arrive at the end of the carrier conveyor and pass beneath the lower horizontal portion of a vacuum elevator having a C-shaped path. The vacuum elevator is provided with a perforated conveying surface and an evacuated plenum chamber for drawing air through the conveying surface of the elevator. At the end of the horizontal carrier conveyor the containers are transferred by a vacuum impulse onto the carrier surface of the vacuum elevator and are elevated to the level at which they arrive at the can washer infeed conveyor. During this transition the containers travel through a C-shaped path defined by the vacuum elevator. Cans which are misoriented and are not drawn by vacuum impulse to the vacuum elevator will be dropped off the end of the horizontal conveyor.

While in transit on the C-shaped elevator the containers are held to the elevator carrier surface by their top or open ends. As they move through the C-shaped path, the cans arrive at the point of elevation and travel now with open end down horizontally away from the elevator exit on a take away vacuum conveyor which continues to draw lubricating oil by gravity flow and vacuum pull. There is a horizontal gap between the horizontal take away conveyor and a mass accumulator conveyor leading to the can washer equipment. Any can which has fallen down on the take away conveyor will drop through the gap and out of the manufacturing line.

The gap is bridged by an overhead vacuum transfer conveyor which picks up properly oriented containers from the end of the take away conveyor moving them across the gap depositing them onto the mass accumulator conveyor. The vacuum transfer mechanism is provided with a perforated conveyor surface and an evacuated plenum chamber which provides the vacuum needed to pull or draw cans from the take away conveyor and carry them to the mass accumulator.

In another form of the invention, can bodies are delivered from trimmer equipment onto a lower horizontal vacuum conveyor leading into a S-shaped vacuum elevator, the cans having open ends on the conveyor surface. In this form of the invention there is a gap between the horizontal conveyor and the entrance to the elevator in order to remove misoriented containers. The gap is bridged by an overhead vacuum transfer conveyor in the same manner as that described above. The S-shaped vacuum conveyor is fitted with a perforated belt and evacuated plenum chamber for receiving and holding the cans during elevation. After elevation, the containers are still oriented with open ends against the conveyor surface and are transferred to a mass flow accumulator conveyor for carriage into a can washer mechanism.

In each form of the invention, the vacuum conveyor mechanisms draw surface bound oil from the can surfaces into their plenum chambers for transfer to a soluble oil recovery system. In addition the interior of the vacuum elevator is fitted with a spray system for washing oil from its interior surfaces.

The wet vacuum system is designed to accommodate multiple rows of cans moving through the manufacturing line in order to reduce can velocity without reducing production rates. Such speed reduction minimizes the throwing of oil from the cans by agitation and centrifugal force and promotes removal by vacuum draw into the systems plenum chambers.

OBJECTS OF THE INVENTION

It is an object of the invention to provide a wet vacuum system for two-piece can lines in which lubricant oil is recovered for storage, disposal, or recycling.

It is a further object of the invention to provide a system for effectively removing lubricant oil from a two-piece can manufacturing line to promote cleanliness in the work area.

Another object of the invention is to remove lubricant oil in the vicinity of a two-piece can manufacturing line so that the oil is not dissipated as mist in the atmosphere in the vicinity of the can line particularly at the high speed elevator equipment used in the line.

Another object of the invention is to provide a soluble oil recovery system producing substantial savings for oil being reused.

Another object of the invention is to provide a can handling system in which downed cans are ejected and in which there is considerable stability provided for cans being conveyed.

A further object of the invention is to provide mass handling of containers between trimmer and washer which results in reduction of can velocity between these points while resulting in higher rates of production in terms of cans produced per unit time.

A further object is to provide a conveying system providing excellent can stability throughout the system.

Other and further objects will occur to those skilled in the art upon employment of the invention in practice and upon an understanding of the detailed description of the invention.

DESCRIPTION OF THE DRAWING

FIG. 3 illustrates schematically another form of the invention and shows the path followed by containers from a trimmer discharge fitting to a first horizontal conveyor and movement of the cans through a S-shaped vacuum elevator path to a mass accumulator.

DESCRIPTION OF THE INVENTION

Figures 1, 2:
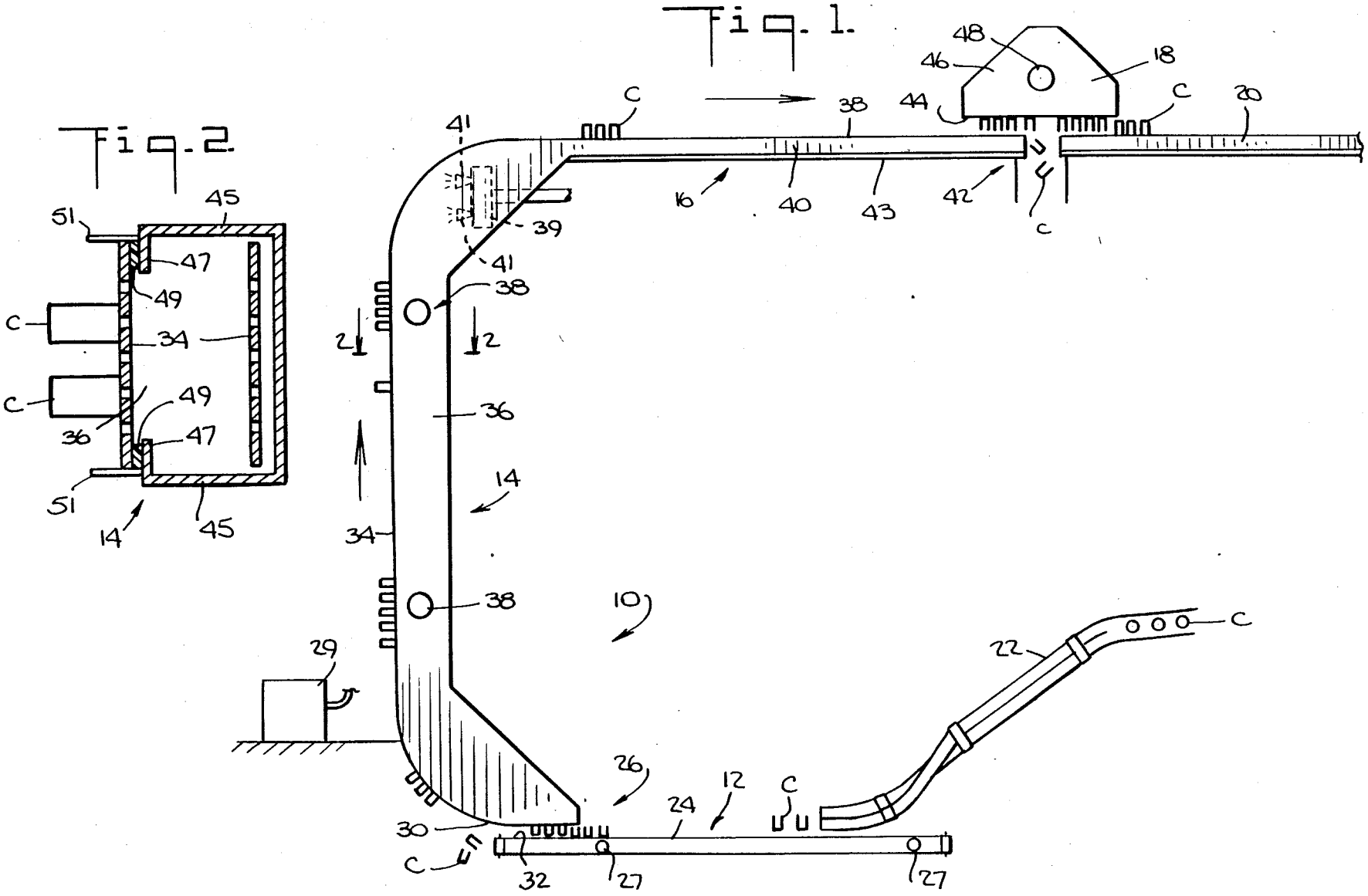
FIG. 1. illustrates schematically one form of the invention and in particular shows the path followed by containers from a trimmer discharge fitting to a first horizontal conveyor, movement of the cans through a C-shaped vacuum elevator path to an elevator outfeed conveyor, and transfer by an overhead vacuum conveyor to a mass accumulator conveyor leading to a washer infeed conveyor.
FIG. 2 is an enlarged section view taken along line 2—2 of FIG. 1.

Referring to FIGS. 1 and 2 of the drawing, one form of the wet vacuum system 10 includes a lower level horizontal vacuum infeed conveyor 12, a C-shaped vacuum elevator conveyor 14, an upper level horizontal vacuum take away conveyor 16, an overhead vacuum transfer conveyor 18, and a mass accumulator conveyor 20. Cans C are discharged from a can line trimmer (not shown) into one or more discharge fittings 22. At this point the cans are rolling along their cylindrical body surfaces into the discharge fittings. The discharge fittings are twisted at mid-point in their length for orienting the can bodies from a rolling mode to a bottom down standing position on the horizontal infeed conveyor 12. It is to be understood that in this point of manufacture the can bodies have been fully formed and trimmed to proper length with closed bottoms and open top ends. The cans also have on their exterior and interior surfaces a residue of oil used to lubricate the cans at various stages of formation.

The horizontally disposed vacuum infeed conveyor 12 has a perforated upper conveying surface 24 preferably in the form of a chain surface and carries the cans to the transfer point 26 to the vacuum elevator. The vacuum conveyor 12 has a subjacent plenum 28 fitted with one or more blowers 27 for drawing ambient air through the conveyor surface for drawing oil from the can bodies and stabilizing the cans on the carrier surface 24. The collected oil is removed to a central receiving station 29 for the soluble oil. At the transfer station 26, the entry point 30 of the vacuum elevator overlies the end 32 of the horizontal vacuum conveyor. At this point the cans are drawn onto the vacuum elevator 14. Cans which have fallen down on the horizontal conveyor 24 are dropped off the end of the conveyor for further handling and restoration in proper orientation to the production line. At the transfer station it is appropriate to apply vacuum from the vacuum elevator to the top of the cans and to eliminate the vacuum at the horizontal conveyor in order to provide a vacuum impulse promoting can transfer.

The vacuum elevator 14 in this embodiment of the invention follows a C-shaped path and is provided with an endless perforated conveying surface 34 which is perforated and preferably in the form of a chain conveyor. The vacuum elevator is provided with a plenum chamber 36 maintained at subatmospheric pressure by blowers 38 drawing air through the conveying surface to hold the containers onto the conveying surface. Additionally, oil which is in the interior of the cans or on the exterior surface is drawn into the vacuum elevator plenum chamber and conducted eventually to the soluble oil recovery system 29. In traversing the C-shaped path the cans are inverted with their open ends down. The cans in this orientation are received by the upper level horizontal vacuum conveyor 16 of similar construction and purpose as the lower level vacuum conveyor and including a perforated conveyor surface 39 and plenum chmmber 40 which is open to the elevator plenum 36. If desired a full length drip pan 43 underlies conveyor 16. There is a gap 42 between the horizontal vacuum conveyor and the mass accumulator conveyor 20 so that cans not properly oriented are dropped out of the system. The gap is bridged by overhead vacuum transfer conveyor 18 having an endless perforated surface conveying 44 and a plenum chamber 46 maintained by blower 48 at subatmospheric pressure such that cans are transferred across the gap and deposited on the mass accummulator conveyor 20 providing infeed to a can washer (not shown).

FIG. 2 is an enlarged section view of the vacuum elevator conveyor 14. The basic arrangement for the elevator conveyor applies also to the lower and upper horizontal conveyors 12 and 16. As shown in FIG. 2, the elevator conveyor includes an enclosed plenum chamber 36 evacuated by blowers 38 (FIG. 1). Side walls 45 are turned in at their upper ends to form supporting flanges 47. Perforated conveyor surface 34 is a low friction vacuum chain running over ultra high molecular weight polyethylene wear strips 49. Side guide rails aid in confining can bodies at the conveying surface.

In operation, a can trimmer delivers formed and trimmed can bodies C to discharge fitting in a rolling mode for orientation to can bottom down position and delivery to infeed conveyor 12. The infeed conveyor vacuum plenum 28 draws oil from the can bodies, as they are conveyed to transfer point 26. Here, the cans properly oriented are lifted away by vacuum elevator 36, and after arriving at upper conveyor 16 are transferred by overhead vacuum transfer head 18 to mass accumulator conveyor 20. Misoriented cans drop out of the system at transfer point 26 or at gap 42.

It is to be understood that the cans move through this system en masse, i.e., not in single file but in a random flow of two or more can rows along a path approximately 12 inches wide such that the velocity of the can bodies is substantially reduced while high production rates are accommodated. By virture of the reduction in can velocity there is greater residence time in the vacuum system to increase the quantity of oil removed from each can. Additionally, by travelling at slower speeds particularly through turns in the conveying system there is less opportunity for the lubricant oil to be thrown from the cans by reason of centrifical force or other agitation of the cans.

For example, cans arriving from the trimmer are moving at approximately 400 feet per minute at approximately 1,000 cans per minute per infeed chute 22. The horizontal conveyor 12 and the vacuum elevator 14 receive and convey the incoming cans at a speed of about 125 fpm and at a production rate of 2,000 cans per minute. The mass accumulator conveyor further reduces speed to about 40 fpm at 2,000 cpm. In this way, agitation of the cans so that there is reduced opportunity for throwing off oil droplets onto machinery, flooring, and as mist into the atmosphere.

As a further aspect of the invention, the vacuum elevator is provided with an internal spray header 39 comprising a plurality of nozzles 41 for spraying the interior of the plenum for removal of soluble oil therefrom and for delivery to the oil recovery system 29.

Figures 4, 5:
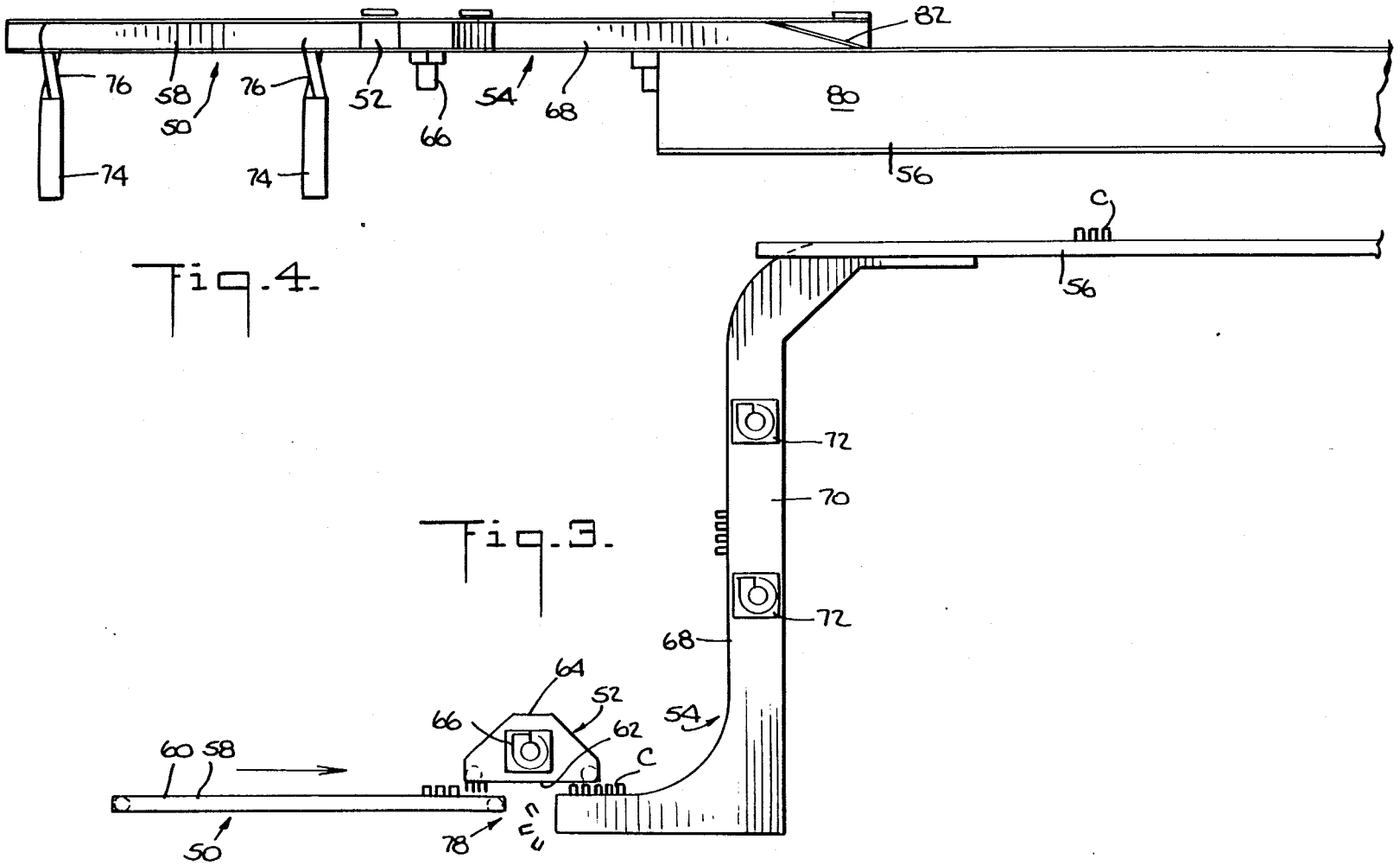
FIG. 4 is a fragmentary plan view of FIG. 3 showing transfer of can bodies laterally from elevator outfeed to a mass accumulator conveyor.

Another form of the invention is shown in FIGS. 3 and 4, and includes a horizontal infeed vacuum conveyor 50, overhead vacuum transfer unit 52, S-shaped vacuum elevator 54 and mass accumulator conveyor 56. These components of the system form a portion of the can manufacturing line between can trimmer and can washer (which are not shown).

The components of this form of the invention are substantially the same in basic construction and operation as those shown in FIGS. 1 and 2. The conveyor 50 includes perforated conveyor surface and evacuated plenum chamber 60. Overhead vacuum transfer unit 52 includes an endless perforated conveyor 62, plenum chamber 64, and blower 66. The elevator conveyor is of S-shaped configuration and includes perforated conveyor 68, plenum 70, and blowers 72.

Cans C discharged from the trimmer move through doubling boxes 74 through twist chutes 76 onto the surface of conveyor 50. Misoriented cans fall from conveying surface 58 though gap 78 and out of the manufacturing line. Properly oriented conveyors are lifted over the gap by overhead transfer conveyor 52 to the entry of the elevator. The cans are oriented open end down for this embodiment of the invention.

After elevation, the cans are discharged laterally onto mass accumulator conveyor surface 80 by guide member 82 for conveyance into the can washer.

By reason of the vacuum conveyance, oil is drawn from the surface of the cans and sent to a central oil collection system. Here again the manufacturing area and atmosphere are maintained in a clean and sanitary condition.

It will be therefore seen that the present invention provides a new and useful wet vacuum systmem for increasing production rates for promoting sanitation in the vicinity of the manufacturing line as well as in the atmosphere of the factory. Considerable savings can be realized by recovery and reuse of the lubricating oil being used.

I claim:

1. In a can manufacturing line for fabricating cans in which an oil lubricant coats the surface of the can bodies, a wet transfer system comprising means for delivering cans to the wet transfer system, a first horizontally oriented infeed conveyor for receiving cans from such means in upright orientation at one end thereof, said horizontal conveyor having a perforated conveying surface and a subjacent evacuated plenum, said conveyor being adapted for moving the cans to a transfer point near the other end of the conveyor, an elevator conveyor adjacent said other end, said elevator conveyor being arranged to convey the can bodies from a first elevation to a second elevation, the elevator conveyor having a perforated endless conveying surface and an evacuated subjacent plenum for drawing the cans and conveying them vertically to the second level, a second horizontally oriented take away vacuum conveyor located at the discharge from the elevator conveyor, a mass accumulating conveyor, and means for transferring can bodies from the second horizontal take away conveyor to the mass accumulating conveyor so that surface bound oil is drawn from the can bodies during transit of each vacuum conveyor.

2. A wet transfer system as defined in claim 1 in which the vacuum elevator conveyor has a C-shaped configuration.

3. A wet vacuum transfer system according to claim 2 in which the elevator conveyor receives cans with bottom end touching the first horizontal conveyor surface and delivers them to the second horizontal conveyor with open ends touching the conveyor surface.

4. A wet vacuum transfer system according to claim 3 in which the entrance to the elevator conveyor overlies the exit from the first horizontal conveyor and draws cans therefrom by vacuum impulse.

5. A wet transfer system according to claim 4 in which cans not drawn to the elevator conveyor are dropped from the infeed conveyor.

6. A wet vacuum transfer system according to claim 5 in which the interior of the vacuum elevator plenum is provided with means for rinsing oil from the interior of the plenum.

7. A wet vacuum transfer system according to claim 1 in which there is a gap between the second horizontal conveyor and the mass accumulator conveyor so that misoriented cans drop from the system through the gap, and the means for transferring cans across the cap comprises an overhead vacuum tansfer unit for lifting cans from the second horizontal conveyor moving them across the gap and depositing the same on the mass accumulator conveyor.

* * * * *